US010403223B2

(12) United States Patent
Wen et al.

(10) Patent No.: US 10,403,223 B2
(45) Date of Patent: Sep. 3, 2019

(54) DISPLAY APPARATUS AND DRIVING METHOD THEREOF

(71) Applicant: Au Optronics Corporation, Hsinchu (TW)

(72) Inventors: Chun-Kuei Wen, Hsinchu (TW); Hung-Min Shih, Changhua County (TW)

(73) Assignee: Au Optronics Corporation, Hsinchu (TW)

( * ) Notice: Subject to any disclaimer, the term of this patent is extended or adjusted under 35 U.S.C. 154(b) by 0 days.

(21) Appl. No.: 15/954,603

(22) Filed: Apr. 17, 2018

(65) Prior Publication Data

US 2019/0012978 A1 Jan. 10, 2019

(30) Foreign Application Priority Data

Jul. 5, 2017 (TW) ..... 106122547 A

(51) Int. Cl.
*G09G 3/36* (2006.01)
*G09G 3/20* (2006.01)

(52) U.S. Cl.
CPC ..... *G09G 3/3677* (2013.01); *G09G 3/2018* (2013.01); *G09G 3/3614* (2013.01); *G09G 3/3648* (2013.01); *G09G 3/3688* (2013.01); *G09G 2300/0426* (2013.01); *G09G 2310/0297* (2013.01); *G09G 2310/062* (2013.01); *G09G 2330/021* (2013.01)

(58) Field of Classification Search
CPC .. G09G 3/3677; G09G 3/2018; G09G 3/3614; G09G 3/3648; G09G 3/3688; G09G 2300/0426; G09G 2310/0297; G09G 2310/062; G09G 2330/021
USPC ..... 345/691
See application file for complete search history.

(56) References Cited

U.S. PATENT DOCUMENTS

| | | | | |
|---|---|---|---|---|
| 9,607,559 | B2 | 3/2017 | Wen et al. | |
| 2012/0113340 | A1 | 5/2012 | Yaguma et al. | |
| 2014/0160172 | A1* | 6/2014 | Lee | G09G 3/3607 345/690 |
| 2015/0109347 | A1* | 4/2015 | Wen | G09G 3/3607 345/690 |

FOREIGN PATENT DOCUMENTS

| | | |
|---|---|---|
| CN | 103745697 | 8/2016 |
| TW | 201232137 | 8/2012 |
| TW | I397051 | 5/2013 |

* cited by examiner

*Primary Examiner* — Amare Mengistu
*Assistant Examiner* — Gloryvid Figueroa-Gibson
(74) *Attorney, Agent, or Firm* — JCIPRNET

(57) ABSTRACT

A display apparatus and a driving method thereof are provided. A data driving chip provides a plurality of data voltages to a plurality of multiplexers through a plurality of output lines. When the display apparatus displays a pure gray pattern, the data voltages are alternately provided to a first data line group and a second data line group during a scan line driving period of each of the scan lines to make two adjacent pixels have different polarities. During a blank period, a plurality of data lines corresponding to a plurality of pixels having the same color and the same polarity on two adjacent scan lines are electrically coupled to each other through the data driving chip to share charges.

17 Claims, 5 Drawing Sheets

DISPLAY APPARATUS AND DRIVING METHOD THEREOF

CROSS-REFERENCE TO RELATED APPLICATION

This application claims the priority benefit of Taiwan application serial no. 106122547, filed on Jul. 5, 2017. The entirety of the above-mentioned patent application is hereby incorporated by reference herein and made a part of this specification.

BACKGROUND OF THE INVENTION

Field of the Invention

The disclosure relates to an electronic apparatus and particularly relates to a display apparatus and a driving method thereof.

Description of Related Art

In response to the demands for products of high speed, high efficiency, and small size, electronic parts nowadays have been rapidly miniaturizing, and various portable electronic apparatuses, such as note books, cell phones, electronic dictionaries, personal digital assistants (PDAs), web pads, and tablet personal computers (tablet PCs) are becoming mainstream. As for image display panels of the portable electronic apparatuses, liquid crystal display (LCD) panels having excellent properties including efficient utilization of space, high definition, low power consumption, and free of radiation have been widely used to satisfy the demands for miniaturization.

Generally speaking, a LCD panel is mainly formed by a plurality of scan lines, a plurality of data lines, and a plurality of pixels respectively driven by the corresponding scan lines and the corresponding data lines. Along with the continuous increase in the resolution and the upgrading frequency of the LCD panels, the upgrading frequency of the scan lines increases, and the power consumption of the LCD panels thereby increases. As a result, how to reduce the power consumption of the LCD panels to meet the trend of energy conservation has become an important issue.

SUMMARY OF THE INVENTION

The embodiment of the invention provides a display apparatus including a plurality of scan lines, a first data line group, a second data line group, a plurality of pixels, a plurality of multiplexers, and a data driving chip. The first data line group includes a plurality of first data lines. The second data line group includes a plurality of second data lines. The pixels are disposed on intersections of the scan lines and the data lines and are electrically coupled to the scan lines and the data lines corresponding to the pixels. The multiplexers are respectively electrically coupled to the first data lines and the second data lines corresponding to the multiplexers. The multiplexers alternately provide a plurality of data voltages to the first data line group and the second data line group during a scan line driving period of each of the scan lines. The data driving chip has a plurality of output lines, and the output lines are respectively electrically coupled to the multiplexers and provide a plurality of data voltages to the multiplexers. Two adjacent output lines of the output lines are configured to provide data voltages with different polarities, so that two adjacent pixels of the pixels have different polarities. When the display apparatus displays a pure gray pattern, the data lines corresponding to the pixels having the same color and the same polarity on two adjacent scan lines of the scan lines are electrically coupled to each other through the data driving chip during a blank period to share charges.

In an embodiment of the invention, the first data line group and the second data line group respectively have a different driving order during the scan line driving period of the adjacent scan lines.

In an embodiment of the invention, a plurality of data line groups sharing charges during two adjacent blank periods are different data line groups.

In an embodiment of the invention, the display apparatus further includes a first switch element, a second switch element, a third switch element, a fourth switch element, a fifth switch element, and a sixth switch element. The output lines are divided into a plurality of output line groups, and each of the output line groups includes a first output line, a second output line, a third output line, a fourth output line, a fifth output line, and a sixth output line arranged adjacently in order. The first switch element is coupled between the second output line and the fourth output line, the second switch element is coupled between the third output line and the fifth output line, the third switch element is coupled between the first output line and the third output line, the fourth switch element is coupled between the second output line and the sixth output line, the fifth switch element is coupled between the fourth output line and the sixth output line, and the sixth switch element is coupled between the first output line and the fifth output line.

In an embodiment of the invention, the pixels on one of the data lines are arranged in a zigzag manner.

In an embodiment of the invention, a length of time for sharing the charges during each blank period is different.

In an embodiment of the invention, the display apparatus further includes a scan driving chip that is coupled to the scan lines and drives the scan lines in order.

In an embodiment of the invention, the two adjacent multiplexers are respectively electrically coupled to two of the first data lines, and the two first data lines are adjacent to each other. Furthermore, the two adjacent multiplexers are respectively electrically coupled to two of the second data lines, and the two second data lines are adjacent to each other.

In an embodiment of the invention, the two adjacent multiplexers are respectively electrically coupled to two of the first data lines, and the two first data lines are adjacent to each other. The two adjacent multiplexers are respectively electrically coupled to two of the second data lines, and the two first data lines are located between the two second data lines.

In an embodiment of the invention, the two adjacent multiplexers are respectively electrically coupled to two of the second data lines, and the two second data lines are adjacent to each other. The two adjacent multiplexers are respectively electrically coupled to two first data lines, and the two second data lines are located between the two first data lines.

The embodiment of the invention also provides a driving method of a display apparatus. The display apparatus includes a plurality of scan lines, a first data line group, a second data line group, and a plurality of pixels. The pixels are disposed on intersections of the scan lines and the data lines and electrically coupled to the scan lines and the data lines corresponding to the pixels. Two adjacent pixels of the pixels have different polarities. The driving method of the display apparatus includes following steps. When the display apparatus displays a pure gray pattern, providing a plurality of data voltages alternately to the first data line group and the second data line group during a scan line driving period of each of the scan lines. The data lines corresponding to the pixels having the same color and the same polarity on adjacent scan lines of the scan lines are connected during a blank period to share charges.

In an embodiment of the invention, the first data line group and the second data line group respectively have a different driving order during the scan line driving period of the adjacent scan lines, and a plurality of data line groups sharing the charges during two adjacent blank periods are different data line groups.

In an embodiment of the invention, the driving method of the display apparatus includes adjusting a length of time for sharing the charges according to a color of the pure gray pattern.

The embodiment of the invention provides a display apparatus including a plurality of scan lines, a first data line group, a second data line group, a plurality of pixels, a plurality of multiplexers, a data driving chip, and a scan driving chip. The scan lines include a first scan line, a second scan line, and a third scan line arranged adjacently in order. The first data line group includes a plurality of first data lines. The second data line group includes a plurality of second data lines. The pixels are disposed on intersections of the scan lines and the data lines and electrically coupled to the scan lines and the data lines corresponding to the pixels. The multiplexers are respectively electrically coupled to the first data lines and the second data lines corresponding to the multiplexers. The data driving chip is electrically coupled to the multiplexers. The scan driving chip includes a first scan signal, a second scan signal, and a third scan signal. The first scan line receives the first scan signal, the second scan line receives the second scan signal, and the third scan line receives the third scan signal. During a scan line driving period of the first scan line, the first scan signal is at a high voltage, and the multiplexers select to electrically couple the data driving chip to the first data lines and then select to electrically couple the data driving chip to the second data lines. During a scan line driving period of the second scan line, the second scan signal is at a high voltage, and the multiplexers select to electrically couple the data driving chip to the second data lines and then select to electrically couple the data driving chip to the first data lines.

In an embodiment of the invention, the display apparatus further includes a first blank period between the scan line driving period of the first scan line and the scan line driving period of the second scan line, wherein parts of the second data lines share charges during the first blank period.

In an embodiment of the invention, during a scan line driving period of the third scan line, the third scan signal is at a high voltage, and the multiplexers firstly select to electrically couple the data driving chip to the first data lines and then select to electrically couple the data driving chip to the second data lines.

In an embodiment of the invention, the display apparatus further includes a second blank period between the scan line driving period of the second scan line and the scan line driving period of the third scan line, wherein parts of the first data lines share charges during the second blank period.

Based on the above, the data driving chip provided in the embodiments of the invention may provide the data voltages to the multiplexers through the output lines. As such, when the display apparatus displays a pure gray pattern, the multiplexers alternately provide the data voltages to the first data line group and the second data line group during the scan line driving period of each of the scan lines. The two adjacent output lines of the output lines provide the data voltages with different polarities, so that the two adjacent pixels of the pixels have different polarities. The data driving chip electrically couples the data lines corresponding to the pixels having the same color and the same polarity on the two adjacent scan lines of the scan lines to each other during the blank period to share charges, and the power consumption of the display apparatus may be reduced.

To make the aforementioned and other features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1:
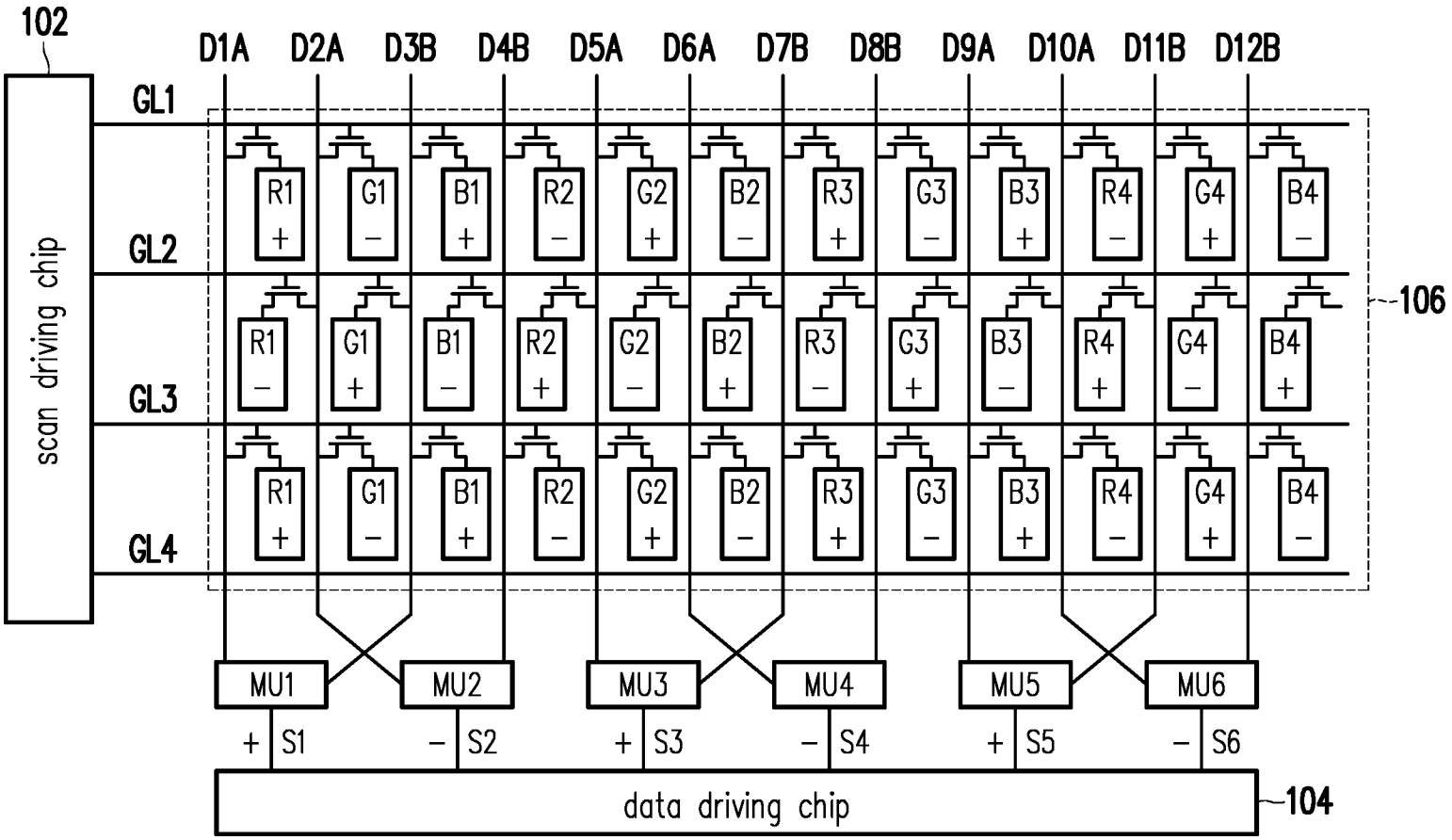
FIG. 1 is a schematic view of a display apparatus according to an embodiment of the invention.

Some other embodiments of the invention are provided as follows. It should be noted that the reference numerals and part of the contents of the previous embodiment are used in the following embodiments, in which identical reference numerals indicate identical or similar components, and repeated description of the same technical contents is omitted. Please refer to the description of the previous embodiment for the omitted contents, which will not be repeated hereinafter.

FIG. 1 is a schematic view of a display apparatus according to an embodiment of the invention. Please refer to FIG. 1. The display apparatus includes a scan driving chip 102, a data driving chip 104, a plurality of multiplexers MU1-MU6, and a display panel 106. The display panel 106 is electronically coupled to the scan driving chip 102 and the multiplexers MU1-MU6, and the multiplexers MU1-MU6 are further electronically coupled to the data driving chip 104. The display panel 106 includes a plurality of scan lines GL1-GL4, a plurality of first data lines D1A, D2A, D5A, D6A, D9A, and D10A, and a plurality of second data lines D3B, D4B, D7B, D8B, D11B, and D12B, wherein the first data lines D1A, D2A, D5A, D6A, D9A, and D10A form a first data line group, and the second data lines D3B, D4B, D7B, D8B, D11B, and D12B form a second data line group. Plural pixels are disposed on intersections of the data lines D1A-D12B and the scan lines GL1-GL4 and are electrically coupled to the scan lines and the data lines corresponding to the pixels. The color corresponding to the pixels on each of the scan lines is arranged in a repeated order of red, green, and blue (marked in order as R1, G1, B1, R2, G2, B2, R3, . . . , G4, and B4 in FIG. 1).

The scan driving chip 102 drives the scan lines GL1-GL4. For instance, the scan driving chip 102 respectively provides a first scan signal, a second scan signal, a third scan signal, and a fourth scan signal to the scan lines GL1-GL4, so that the first scan line GL1 receives the first scan signal, the second scan line GL2 receives the second scan signal, the third scan line GL3 receives the third scan signal, and the fourth scan line GL4 receives the fourth scan signal, and that the scan lines GL1-GL4 are driven in sequence. The data driving chip 104 has a plurality of output lines S1-S6, and the output lines S1-S6 are respectively electrically coupled to the multiplexers MU1-MU6 and provide a plurality of data voltages to the multiplexers MU1-MU6, wherein two adjacent output lines of the output lines S1-S6 provide data voltages with different polarities. For instance, in this embodiment, the output lines S1, S3, and S5 provide data voltages with the positive polarity, and the output lines S2, S4, and S6 provide data voltages with negative polarity.

The multiplexers MU1-MU6 are respectively electrically coupled to the first data lines and the second data lines corresponding to the multiplexers MU1-MU6. Two of the first data lines D1A, D2A, D5A, D6A, D9A, and D10A respectively electrically coupled to two adjacent multiplexers of the multiplexers MU1-MU6 are adjacent to each other. Two of the second data lines D3B, D4B, D7B, D8B, D11B, and D12B respectively electrically coupled to two adjacent multiplexers of the multiplexers MU1-MU6 are adjacent to each other. In addition, the two adjacent first data lines and the two adjacent second data lines are adjacent to each other. For instance, in the embodiment depicted in FIG. 1, the two first data lines D1A and D2A respectively electrically coupled to the adjacent multiplexers MU1 and MU2 are adjacent to each other. In addition, the two first data lines D3B and D4B respectively electrically coupled to the two adjacent multiplexers MU1 and MU2 are adjacent to each other. Additionally, the adjacent first data lines D1A and D2A and the adjacent first data lines D3B and D4B are adjacent to each other. Similarly, the data lines D5A-D8B electrically coupled to the adjacent multiplexers MU3 and MU4 and the data lines D9A-D12B electrically coupled to the adjacent multiplexers MU5 and MU6 are arranged in a similar manner and hence are not further described herein. In the embodiment shown in FIG. 1, the multiplexer MU1 is adjacent to the multiplexer MU2, but the invention is not limited thereto. In response to the manufacturing need or the requirement for design of traces, the multiplexer MU1 and the multiplexer MU2 are not physically adjacent to each other but respectively electrically coupled to the adjacent output line S1 and output line S2, which also constitutes the adjacent relationship between the multiplexer MU1 and the multiplexer MU2.

The multiplexers MU1-MU6 provide a plurality of data voltages provided by the output lines S1-S6 alternately to the first data line group and the second data line group during a scan line driving period of each of the scan lines GL1-GL4, wherein the first data line group and the second data line group respectively have a different driving order during the scan line driving period of the adjacent scan lines, so that two adjacent pixels have different polarities. For instance, according to the present embodiment, the pixels on the display panel 102 are in a zigzag configuration. With reference to FIG. 1, the pixels on a data line are arranged in a zigzag manner. For instance, the data line D2A is electrically coupled to a pixel located on the second column and the first row, a pixel on the first column and the second row, and a pixel on the second column and the third row, and the data line D3B is electrically coupled to a pixel located on the third column and the first row, a pixel on the second column and the second row, and a pixel on the third column and third row, which should however not be construed as limitations to the invention. The pixels on the other data lines are arranged in a similar manner and thus are not explained herein.

Figure 2:
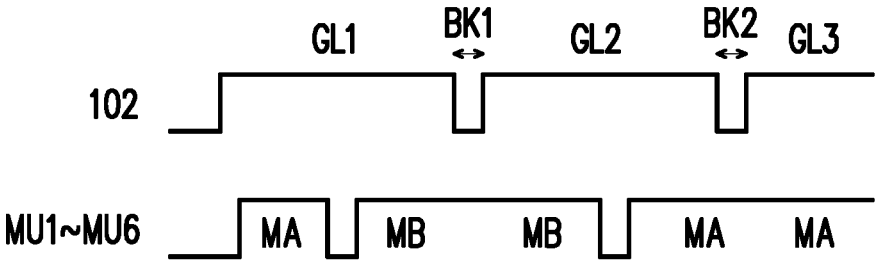
FIG. 2 is a schematic timing diagram of driving a first data line group and a second data line group according to an embodiment of the invention.

A timing diagram of driving the first data line group and the second data line group is illustrated as in FIG. 2, for example. Please refer to both FIG. 1 and FIG. 2. A driving sequence executed by the scan driving chip 102 is marked as 102 in FIG. 2. For instance, during a period in which the scan line GL1 is being driven (i.e., the scan line driving period of the first scan line, such as GL1 in FIG. 2, during which the first scan signal is at a high voltage,) the multiplexers MU1-MU6 select to electrically couple the data driving chip 104 to the first data lines D1A, D2A, D5A, D6A, D9A, and D10A so as to drive a first data line group MA, and the multiplexers MU1-MU6 then select to electrically couple the data driving chip 104 to the second data lines D3B, D4B, D7B, D8B, D11B, and D12B so as to drive a second data line group MB. During a period in which the scan line GL2 is being driven (i.e., a scan line driving period of the second scan line, such as GL2 in FIG. 2, during which the second scan signal is at a high voltage,) the multiplexers MU1-MU6 select to electrically couple the data driving chip 104 to the second data lines D3B, D4B, D7B, D8B, D11B, and D12B so as to drive the second data line group MB, and the multiplexers MU1-MU6 then select to electrically couple the data driving chip 104 to the first data lines D1A, D2A, D5A, D6A, D9A, and D10A so as to drive the first data line group MA. During a period in which the scan line GL3 is being driven (i.e., a scan line driving period of the third scan line, such as GL3 in FIG. 2, during which the third scan signal is at a high voltage,) the multiplexers MU1-MU6 select to electrically couple the data driving chip 104 to the first data lines D1A, D2A, D5A, D6A, D9A, and D10A so as to drive the first data line group MA, and then the multiplexers MU1-MU6 select to electrically couple the data driving chip 104 to the second data lines D3B, D4B, D7B, D8B, D11B, and D12B so as to drive the second data line group MB. Similarly, during the scan line driving period of the scan line GL4, data voltages are also provided alternately to the first data line group and the second data line group, so that in the display panel 106 the adjacent pixels in an extension direction of the scan lines or in an extension direction of the data lines have different polarities.

In addition, when the display apparatus displays a pure gray pattern (e.g., a grayscale image in red, green, blue, or other colors) other than a white gray pattern, the data driving chip 104 electrically couples the data lines corresponding to the pixels having the same color and the same polarity on two adjacent scan lines during the blank period to share charges. Through the operation of sharing the charges, the voltage amplitude for the data driving chip 104 to drive the data lines decreases significantly, and thus the power consumption of the data driving chip 104 decreases and thereby save electricity. In this embodiment, the scan driving chip 102 does not drive the scan lines during the blank period i.e., during a period between two scan line driving periods of two adjacent scan lines. For instance, referring to FIG. 2, a blank period BK1 is between the scan line driving period of the first scan line GL1 and the scan line driving period of the scan line GL2. In other words, the driving sequence of the scan driving chip 102 is: the scan line driving period of the first scan line GL1, the blank period BK1, the scan line driving period of the second scan line GL2, a blank period BK2, the scan line driving period of the third scan line GL3, . . . , and so on.

In detail, the display apparatus includes a plurality of switch elements, and each of the switch elements is disposed corresponding to the arrangement of the colors of the pixels. As such, during the blank period, the data driving chip 104 controls whether the switch elements are switched on or off, so that the data lines corresponding to the plurality of pixels having the same color and the same polarity on the two adjacent scan lines of the scan lines are electrically coupled to share charges.

Figure 3:
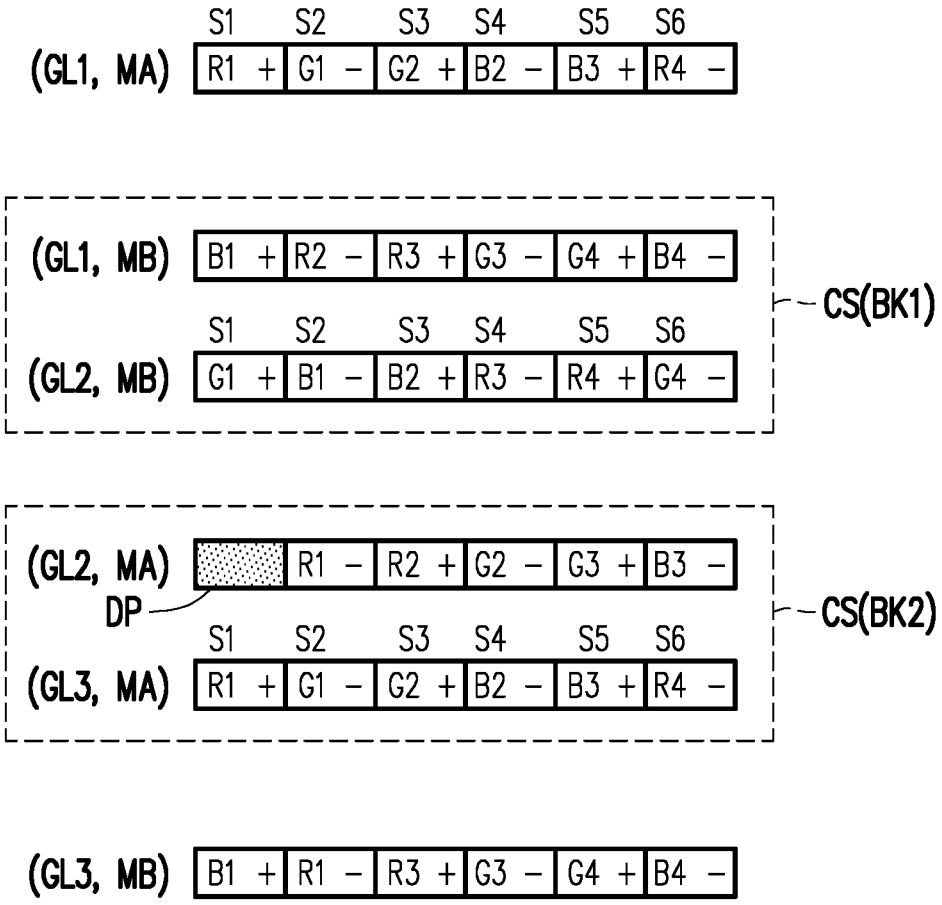
FIG. 3 is a schematic view of a color and a polarity of a plurality of pixels located on scan lines and corresponding to a first data line group and a second data line group according to an embodiment of the invention.
Figure 4:
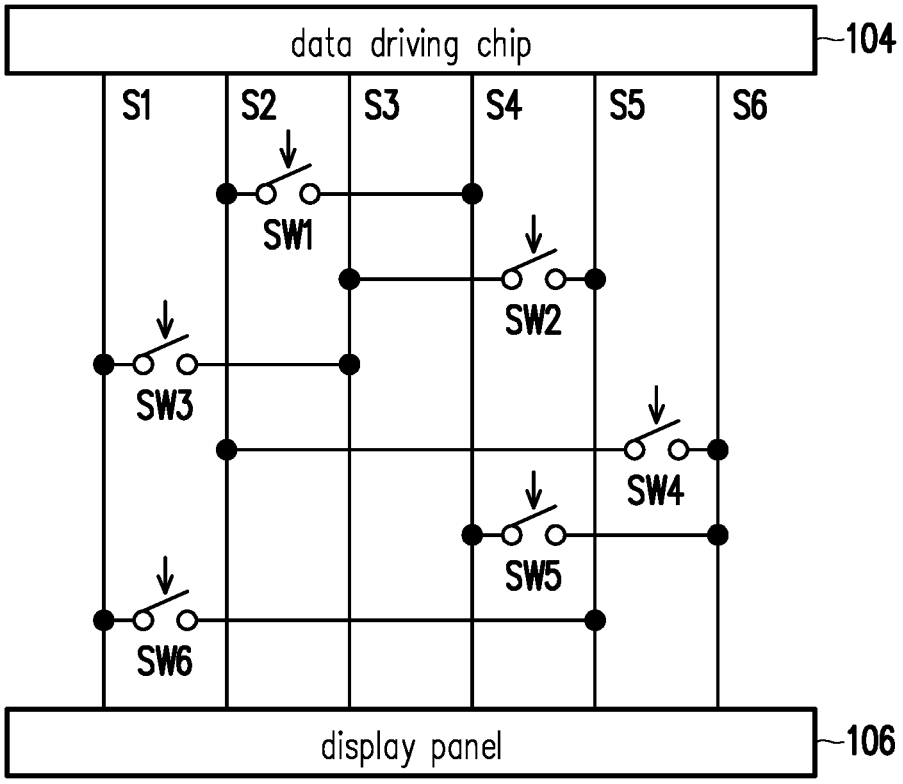
FIG. 4 is a schematic view of an arrangement of a plurality of switch elements corresponding to the pixels depicted in FIG. 3.

For instance, FIG. 3 is a schematic view of the color and the polarity of a plurality of pixels located on scan lines and corresponding to the first data line group and the second data line group according to an embodiment of the invention. FIG. 4 is a schematic view of an arrangement of the switch elements corresponding to the arrangement of the pixels depicted in FIG. 3. Please refer to FIG. 2, FIG. 3, and FIG. 4. The multiplexers MU1-MU6 provide the data voltages alternately to the first data line group MA and the second data line group MB during the scan line driving period of each of the scan lines GL1-GL4. As shown in FIG. 2, during the scan line driving period of each of the scan lines GL1-GL4, the scan signal is at a high voltage. In other words, the multiplexers MU1-MU6 electrically couple the data driving chip 104 alternately to the first data line group MA and the second data line group MB. Moreover, the first data line group MA and the second data line group MB have different driving orders during the scan line driving periods of the adjacent scan lines. For instance, during the scan line driving period of the scan line GL1, the multiplexers MU1-MU6 select to electrically couple the data driving chip 104 to the first data line group MA (marked as (GL1, MA) in FIG. 3) and then select to electrically couple the data driving chip 104 to the second data line group MB (marked as (GL1, MB) in FIG. 3). During the scan line driving period of the scan line GL2, the multiplexers MU1-MU6 select to electrically couple the data driving chip 104 to the second data line group MB (marked as "(GL2, MB)" in FIG. 3) and then select to electrically couple the data driving chip 104 to the first data line group MA (marked as "(GL2, MA)" in FIG. 3).

When the display apparatus displays a pure gray pattern, the data driving chip 104 controls whether the switch elements (e.g., the switch elements SW1-SW6 in FIG. 4) are switched on or off during the blank period, so that the data lines corresponding to the pixels having the same color and the same polarity on the two adjacent scan lines of the scan lines are electrically coupled to share charges.

According to the embodiment depicted in FIG. 4, the display apparatus includes the switch elements SW1-SW6, wherein the first switch element SW1 is coupled between the output line S2 and the output line S4, the second switch element SW2 is coupled between the output line S3 and the output line S5, the third switch element SW3 is coupled between the output line S1 and the output line S3, the fourth switch element SW4 is coupled between the output line S2 and the output line S6, the fifth switch element SW5 is coupled between the output line S4 and the output line S6, and the sixth switch element SW6 is coupled between the output line S1 and the output line S5. During the blank period BK1 between the scan line driving period of the scan line GL1 and the scan line driving period of the scan line GL2, the data driving chip 104 controls whether the switch elements SW1-SW6 are switched on or off and thereby share charges.

In this embodiment, FIG. 3 is a schematic view of transmission of signals between the output lines S1-S6 of the data driving chip 104 and each of the pixels in different driving sequences. Please refer to both FIG. 2 and FIG. 3. In FIG. 3, (GL1, MA) refers to the scan line driving period of the scan line GL1 shown in FIG. 2, and during (GL1, MA) the multiplexers MU1-MU6 performs data transmission of the first data line group MA. Besides, during (GL1, MA), the output line S1 transmits data to a pixel R1+ through the multiplexer MU1, the output line S2 transmits data to a pixel G1− through the multiplexer MU2, the output line S3 transmits data to a pixel G2+ through the multiplexer MU3, the output line S4 transmits data to a pixel B2− through the multiplexer MU4, the output line S5 transmits data to a pixel B3+ through the multiplexer MUS, and the output line S6 transmits data to a pixel R4− through the multiplexer MU6. During (GL1, MB), the output line S1 transmits data to a pixel B1+ through the multiplexer MU1, the output line S2 transmits data to a pixel R2− through the multiplexer MU2, the output line S3 transmits data to a pixel R3+ through the multiplexer MU3, the output line S4 transmits data to a pixel G3− through the multiplexer MU4, the output line S5 transmits data to a pixel G4+ through the multiplexer MU5, and the output line S6 transmits data to a pixel B4− through the multiplexer MU6. Likewise, the following driving periods (GL2, MB), (GL2, MA) . . . are illustrated in FIG. 3 and are not further explained herein.

For instance, please refer to FIG. 4 and the pixels in a circled range CS(BK1) in FIG. 3. The circled range CS(BK1) refers to a plurality of pixels that share charges during the blank period BK1; similarly, a circled range CS(BK2) refers to a plurality of pixels that share charges during the blank period BK2. If the display apparatus is going to display a red pure gray pattern, the switch element SW1 in FIG. 4 is switched on for the pixel R2− to share charges with the pixel R3− during the blank period BK1 and for the output line S2 corresponding to the pixel R2− to be electrically coupled to the output line S4 corresponding to the pixel R3−. Likewise, the switch element SW2 in FIG. 4 is switched on for the pixel R3+ to share charges with the pixel R4+ and for the output line S3 corresponding to the pixel R3+ to be electrically coupled to the output line S5 corresponding to the pixel R4+. Accordingly, the red pixels of the same polarity on the two adjacent scan lines GL1 and GL2 may share charges through switching on the switch element SW1 and the switch element SW2.

Similarly, if the display apparatus displays a blue pure gray pattern, the switch element SW3 in FIG. 4 is switched on for the pixel B1+ to share charges with the pixel B2+ during the blank period BK1 and for the output line S1 corresponding to the pixel B1+ to be electrically coupled to the output line S3 corresponding to the pixel B2+. Likewise, the switch element SW4 in FIG. 4 is switched on for the pixel B4− to share charges with the pixel B1− and for the output line S6 corresponding to the pixel B4− to be electrically coupled to the output line S2 corresponding to the pixel B1−. Accordingly, the blue pixels of the same polarity on the two adjacent scan lines GL1 and GL2 may share charges through switching on the switch element SW3 and the switch element SW4. Similarly, during the blank period BK2 (i.e., the circled range CS(BK2)) between the scan line driving period of the second scan line GL2 and the scan line driving period of the third scan line GL3, the data driving chip 104 controls whether the switch elements SW1-SW6 are switched on or off, so that the pixels having the same color and the same polarity on the two adjacent scan lines GL2 and GL3 (a pixel DP shadowed with screentone in FIG. 3 is a dummy pixel not participating in sharing charges) share charges by electrically coupling corresponding data lines. The method of electrically coupling the data lines to share charges is similar to the method of sharing charges during the blank period BK1 between the scan line driving period of the scan line GL1 and the scan line driving period of the scan line GL2 and thus is not further explained.

Since a length of time required for charges sharing depends on the color of the pure gray pattern or the location of the pixels, it should be mentioned that the data driving chip 104 adjusts a length of time of the blank period required for sharing the charges (i.e., the length of time of each of the blank periods differs with different requirements), so as to achieve the most favorable power-saving effects. In addition, the number of the scan lines, the number of the data lines, the number of the output lines, and the number of the multiplexers provided in the previous embodiments are only exemplary and are not practically limited thereto. For instance, in other embodiments, the number of the scan lines, the number of the data lines, the number of the output lines, and the number of the multiplexers are respectively integral multiples of the number of the scan lines, the number of the data lines, the number of the output lines, and the number of the multiplexers in the embodiment depicted in FIG. 1, for example. For instance, the display apparatus includes a plurality of output line groups, and each of the output line groups respectively includes six output lines as in the embodiment of FIG. 1. Similarly, the display apparatus includes more scan lines, more data lines, and more multiplexers.

Figure 5:
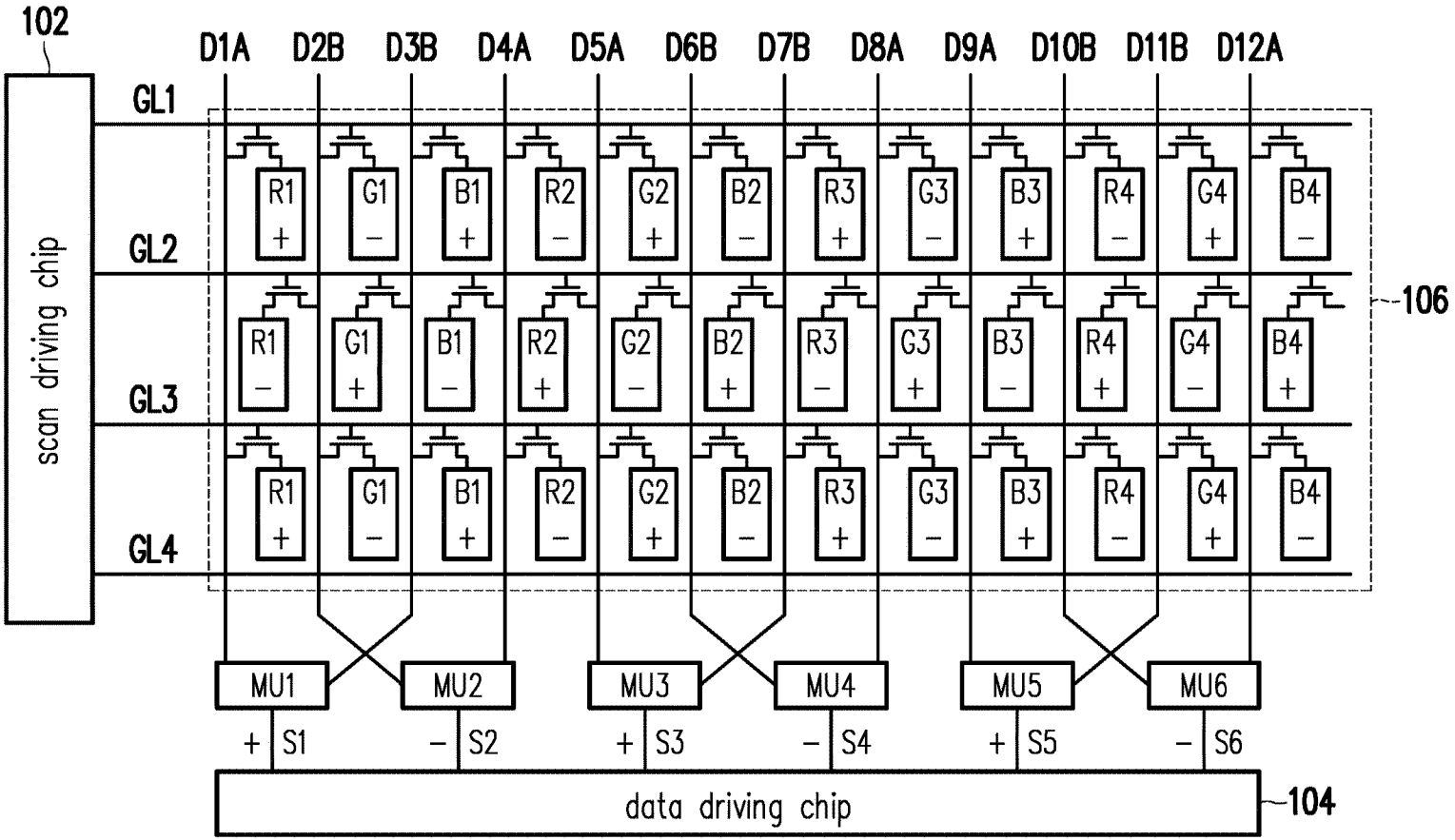
FIG. 5 is a schematic view of a display apparatus according to another embodiment of the invention.

FIG. 5 is a schematic view of a display apparatus according to another embodiment of the invention. Please refer to FIG. 5. This embodiment differs from the embodiment shown in FIG. 1 in the manner of arranging the data lines in the first data line group and the second data line group. In this embodiment, a display panel 106 includes a plurality of first data lines D1A, D4A, D5A, D8A, D9A, and D12A and a plurality of second data lines D2B, D3B, D6B, D7B, D10B, and D11B, wherein the first data lines D1A, D4A, D5A, D8A, D9A, and D12A form a first data line group MA, and the second data lines D2B, D3B, D6B, D7B, D10B, and D11B form a second data line group MB. Pixels are disposed on intersections of the data lines D1A-D12A and the scan lines GL1-GL4 and are electrically coupled to the scan lines and the data lines corresponding to the pixels. In addition, two of the second data lines D2B, D3B, D6B, D7B, D10B, and D11B respectively electrically coupled to two adjacent multiplexers of the multiplexers MU1-MU6 are adjacent to each other, and the two second data lines are located between the two first data lines respectively electrically coupled to the two adjacent multiplexers. For instance, according to the embodiment shown in FIG. 5, the second data lines D2B and D3B respectively electronically coupled to the adjacent multiplexers MU1 and MU2 are adjacent to each other, and the adjacent second data lines D2B and D3B are located between the first data lines D1A and D4A respectively electrically coupled to the adjacent multiplexers MU1 and MU2. Similarly, the data lines D5A-D8B electrically coupled to the adjacent multiplexers MU3 and MU4 and the data lines D9A-D12B electrically coupled to the adjacent multiplexers MU5 and MU6 are arranged in a similar manner and thus will not be further explained. In other embodiments, note that the way to arrange the first data line group and the way to arrange the second data line group as shown in FIG. 5 are exchanged. For instance, the locations of the second data lines D2B and D3B provided in the embodiment of FIG. 5 are exchanged with the locations of the first data lines D1A and D4A, so that the two first data lines respectively electrically coupled to two adjacent multiplexers are adjacent to each other, and the two first data lines are located between the two second data lines respectively electrically coupled to the two adjacent multiplexers.

Figure 6:
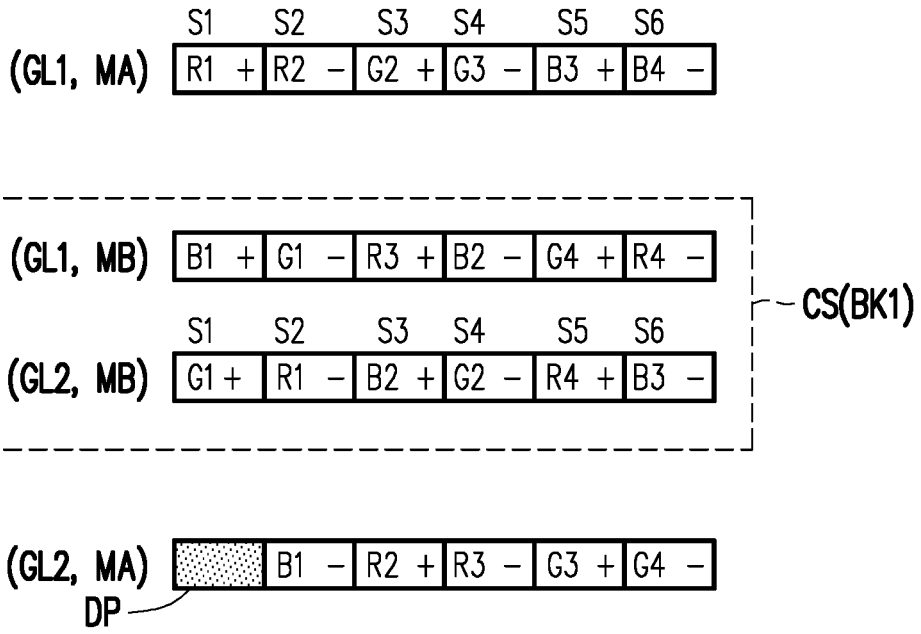
FIG. 6 is a schematic view of a color and a polarity of a plurality of pixels located on scan lines and corresponding to a first data line group and a second data line group according to an embodiment of the invention.

FIG. 6 is a schematic view of a color and a polarity of a plurality of pixels located on scan lines and corresponding to a first data line group and a second data line group according to an embodiment of the invention. Please refer to both FIG. 5 and FIG. 6. Similar to the embodiments shown in FIG. 2-FIG. 4, the multiplexers MU1-MU6 described in this embodiment provide a plurality of data voltages alternately to the first data line group MA and the second data line group MB during the scan line driving period of each of the scan lines GL1-GL4, wherein the first data line group and the second data line group also have a different driving order during the scan line driving periods of the adjacent scan lines. For instance, in FIG. 6, (GL1, MA) represents that the multiplexers MU1-MU6 select to electrically couple the data driving chip 104 to the first data line group MA during the scan line driving period of the first scan line GL1, and (GL1, MB) represents that the multiplexers MU1-MU6 select to electrically couple the data driving chip 104 to the second data line group MB during the scan line driving period of the first scan line GL1. The representations of (GL2, MA) and (GL2, MB) are similar to the above and thus are not repeated hereinafter. When the display apparatus displays a pure gray pattern other than a white gray pattern, the data driving chip 104 electrically couples (through switching on a switch element electrically coupled between the output lines, for example) the data lines corresponding to the pixels having the same color and the same polarity on two adjacent scan lines during the blank period to share charges.

For instance, according to the embodiment shown in FIG. 6, during the blank period BK1 (i.e., the circled range CS(BK1) referring to charges sharing performed during the blank period BK1) between the scan line driving period of the first scan line GL1 and the scan line driving period of the second scan line GL2, if the display apparatus displays a blue pure gray pattern, the switch element SW3 in FIG. 4 is switched on for the pixel B1+ to share charges with the pixel B2+ during the blank period BK1 and for the output line S1 corresponding to the pixel B1+ to be electrically coupled to the output line S3 corresponding to the pixel B2+. Likewise, the switch element SW5 in FIG. 4 is switched on for the pixel B2− to share charges with the pixel B3− and for the output line S4 corresponding to the pixel B2− to be electrically coupled to the output line S6 corresponding to the pixel B3−. Accordingly, the blue pixels of the same polarity on the two adjacent scan lines GL1 and GL2 share charges through switching on the switch element SW3 and the switch element SW5. Similarly, if the display apparatus displays a green pure gray pattern, the switch element SW1 in FIG. 4 is switched on for the pixel G1− to share charges with the pixel G2− during the blank period BK1 and for the output line S2 corresponding to the pixel G1− to be electrically coupled to the output line S4 corresponding to the pixel G2−. Likewise, the switch element SW6 in FIG. 4 is switched on for the pixel G4+ to share charges with the pixel G1+ and for the output line S5 corresponding to the pixel G4+ to be electrically coupled to the output line S1 corresponding to the pixel G1+. Accordingly, the green pixels of the same polarity on the two adjacent scan lines GL1 and GL2 may share charges through switching on the switch element SW1 and the switch element SW6.

Figure 7:
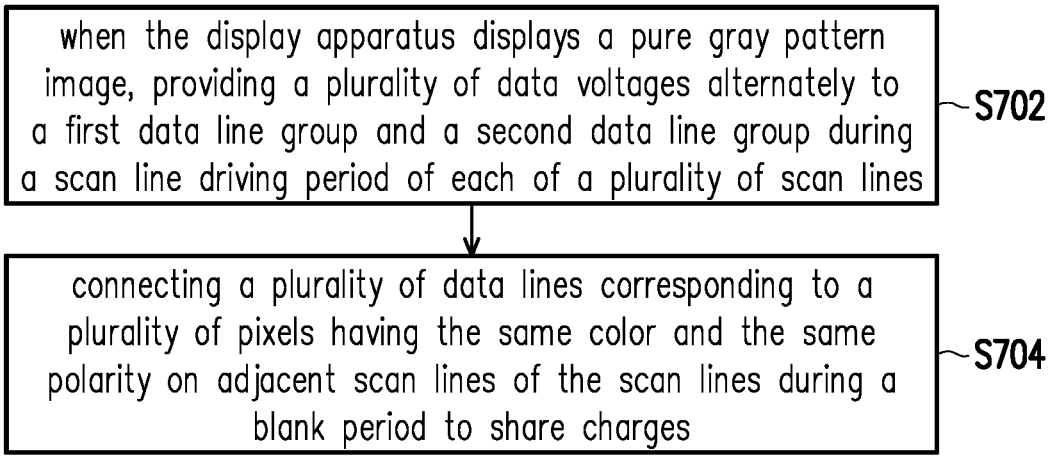
FIG. 7 is a flow chart of a driving method of a display apparatus according to an embodiment of the invention.

FIG. 7 is a flow chart of a driving method of a display apparatus according to an embodiment of the invention. Please refer to FIG. 7. According to the above embodiments, the driving method of the display apparatus includes at least the following steps. Firstly, when the display apparatus displays a pure gray pattern, a plurality of data voltages are provided alternately to a first data line group and a second data line group during a scan line driving period of each of a plurality of scan lines (step S702). The pure gray pattern is in a color other than white, such as in red, green, blue, or other colors. In addition, the first data line group and the second data line group respectively have a different driving order during the scan line driving periods of the adjacent scan lines, and the data line groups sharing the charges during adjacent blank periods are different data line groups. The data lines corresponding to the pixels having the same color and the same polarity on the adjacent scan lines are connected during the blank period to share charges (step S704). The scan lines are not driven during the blank period. The blank period is between two scan line driving periods of two adjacent scan lines, for example. In addition, a length of time for sharing the charges is adjusted, for example, in accordance with the color of pure gray pattern.

To sum up, the data driving chip provided in the disclosure provides the data voltages to the multiplexers through the output lines. As such, when the display apparatus displays a pure gray pattern, the multiplexers alternately provide the data voltages to the first data line group and the second data line group during the scan line driving period of each of the scan lines. The two adjacent output lines provide the data voltages of different polarities, so that the two adjacent pixels have different polarities. The data driving chip electrically couples the data lines corresponding to the pixels having the same color and the same polarity on the two adjacent scan lines to each other during the blank period to share charges. By lowering the voltage amplitude to reduce power consumption, the display panel having the pixels arranged in the zigzag manner achieves the power-saving effects and further reduces the power consumption of the display apparatus.

What is claimed is:

1. A display apparatus, comprising:

a plurality of scan lines;

a first data line group comprising a plurality of first data lines;

a second data line group comprising a plurality of second data lines;

a plurality of pixels disposed on intersections of the plurality of scan lines and the plurality of data lines and electrically coupled to the plurality of scan lines and the plurality of data lines corresponding to the plurality of pixels;

a plurality of multiplexers respectively electrically coupled to the plurality of first data lines and the plurality of second data lines corresponding to the plurality of multiplexers, the plurality of multiplexers alternately providing a plurality of data voltages to the first data line group and the second data line group during a scan line driving period of each of the plurality of scan lines; and a data driving chip having a plurality of output lines, the plurality of output lines being respectively electrically coupled to the plurality of multiplexers and providing a plurality of data voltages to the plurality of multiplexers, wherein two adjacent output lines of the plurality of output lines provide data voltages with different polarities, so that two adjacent pixels of the plurality of pixels have different polarities, wherein when the display apparatus displays a pure gray pattern, the plurality of data lines corresponding to the plurality of pixels having the same color and the same polarity on two adjacent scan lines of the plurality of scan lines are electrically coupled to each other through the data driving chip during a blank period to share charges.

2. The display apparatus according to claim 1, wherein the first data line group and the second data line group respectively have a different driving order during the scan line driving period of the adjacent scan lines.

3. The display apparatus according to claim 2, further comprising a first switch element, a second switch element, a third switch element, a fourth switch element, a fifth switch element, and a sixth switch element, the plurality of output lines being divided into a plurality of output line groups, each of the plurality of output line groups comprising a first output line, a second output line, a third output line, a fourth output line, a fifth output line, and a sixth output line arranged adjacently in order, wherein the first switch element is coupled between the second output line and the fourth output line, the second switch element is coupled between the third output line and the fifth output line, the third switch element is coupled between the first output line and the third output line, the fourth switch element is coupled between the second output line and the sixth output line, the fifth switch element is coupled between the fourth output line and the sixth output line, and the sixth switch element is coupled between the first output line and the fifth output line.

4. The display apparatus according to claim 1, wherein a plurality of data line groups sharing charges during two adjacent blank periods are different data line groups.

5. The display apparatus according to claim 1, wherein the plurality of pixels on one data line of the plurality of data lines are arranged in a zigzag manner.

6. The display apparatus according to claim 1, wherein a length of time for sharing the charges during each blank period is different.

7. The display apparatus according to claim 1, further comprising:

a scan driving chip coupled to the plurality of scan lines and driving the plurality of scan lines in order.

8. The display apparatus according to claim 1, wherein two adjacent multiplexers of the plurality of multiplexers are respectively electrically coupled to two of the plurality of first data lines, the two of the plurality of first data lines are adjacent to each other, the two adjacent multiplexers of the plurality of multiplexers are respectively electrically coupled to two of the plurality of second data lines, and the two of the plurality of second data lines are adjacent to each other.

9. The display apparatus according to claim 1, wherein two adjacent multiplexers of the plurality of multiplexers are respectively electrically coupled to two of the plurality of first data lines, the two of the plurality of first data lines are adjacent to each other, the two adjacent multiplexers are respectively electrically coupled to two of the plurality of second data lines, and the two of the plurality of first data lines are located between the two of the plurality of second data lines.

10. The display apparatus according to claim 1, wherein two adjacent multiplexers of the plurality of multiplexers are respectively electrically coupled to two of the plurality of second data lines, the two of the plurality of second data lines are adjacent to each other, the two adjacent multiplexers are respectively electrically coupled to two of the plurality of first data lines, and the two of the plurality of second data lines are located between the two of the plurality of first data lines.

11. A driving method of a display apparatus, the display apparatus comprising a plurality of scan lines, a first data line group, a second data line group, and a plurality of pixels, the plurality of pixels being disposed on intersections of the plurality of scan lines and the plurality of data lines and electrically coupled to the plurality of scan lines and the plurality of data lines corresponding to the plurality of pixels, wherein two adjacent pixels of the plurality of pixels have different polarities, and the driving method of the display apparatus comprises:

when the display apparatus displays a pure gray pattern, providing a plurality of data voltages alternately to the first data line group and the second data line group during a scan line driving period of each of the plurality of scan lines; and connecting the plurality of data lines corresponding to the plurality of pixels having the same color and the same polarity on adjacent scan lines of the plurality of scan lines during a blank period to share charges.

12. The driving method of the display apparatus according to claim 11, wherein the first data line group and the second data line group respectively have different driving orders during the scan line driving periods of the adjacent scan lines, and a plurality of data line groups sharing the charges during two adjacent blank periods are different data line groups.

13. The driving method of the display apparatus according to claim 11, comprising:

adjusting a length of time for sharing the charges according to a color of the pure gray pattern.

14. A display apparatus, comprising:

a plurality of scan lines comprising a first scan line, a second scan line, and a third scan line arranged adjacently in order;

a first data line group comprising a plurality of first data lines;

a second data line group comprising a plurality of second data lines;

a plurality of pixels disposed on intersections of the plurality of scan lines and the plurality of data lines and electrically coupled to the plurality of scan lines and the plurality of data lines corresponding to the plurality of pixels;

a plurality of multiplexers respectively electrically coupled to the plurality of first data lines and the plurality of second data lines corresponding to the plurality of multiplexers;

a data driving chip electrically coupled to the plurality of multiplexers; and a scan driving chip comprising a first scan signal, a second scan signal, and a third scan signal, wherein the first scan line receives the first scan signal, the second scan line receives the second scan signal, and the third scan line receives the third scan signal, wherein during a scan line driving period of the first scan line, the first scan signal is at a high voltage, and the plurality of multiplexers select to electrically couple the data driving chip to the plurality of first data lines and then select to electrically couple the data driving chip to the plurality of second data lines, and during a scan line driving period of the second scan line, the second scan signal is at a high voltage, and the plurality of multiplexers select to electrically couple the data driving chip to the plurality of second data lines and then select to electrically couple the data driving chip to the plurality of first data lines.

15. The display apparatus according to claim 14, further comprising a first blank period between the scan line driving period of the first scan line and the scan line driving period of the second scan line, wherein parts of the plurality of second data lines share charges during the first blank period.

16. The display apparatus according to claim 15, wherein during a scan line driving period of the third scan line, the third scan signal is at a high voltage, and the plurality of multiplexers firstly select to electrically couple the data driving chip to the plurality of first data lines and then select to electrically couple the data driving chip to the plurality of second data lines.

17. The display apparatus according to claim 16, further comprising a second blank period between the scan line driving period of the second scan line and the scan line driving period of the third scan line, wherein parts of the plurality of first data lines share charges during the second blank period.

* * * * *